United States Patent [19]

Tucker

[11] 4,422,638

[45] Dec. 27, 1983

[54] GOLF PUTTER

[75] Inventor: Richard B. C. Tucker, Baltimore, Md.

[73] Assignee: Wm. T. Burnett & Co., Inc., Baltimore, Md.

[21] Appl. No.: 227,636

[22] Filed: Jan. 23, 1981

[51] Int. Cl.[3] ..... A63B 53/08

[52] U.S. Cl. ..... 273/78; 273/DIG. 8

[58] Field of Search ..... 273/78, 167 J, 173, 273/DIG. 8, 168

[56] References Cited

U.S. PATENT DOCUMENTS

| | | | |
|---|---|---|---|
| 3,211,455 | 10/1965 | Hyden | 273/78 |
| 3,937,474 | 2/1976 | Jepson et al. | 273/DIG. 8 |

FOREIGN PATENT DOCUMENTS

| | | | |
|---|---|---|---|
| 646942 | 8/1962 | Canada | 273/78 |
| 23691 | of 1906 | United Kingdom | 273/78 |
| 2003 | of 1914 | United Kingdom | 273/78 |

OTHER PUBLICATIONS

"Golf Digest", vol. 20, No. 12, Dec. 1969, p. 25.

*Primary Examiner*—George J. Marlo
*Attorney, Agent, or Firm*—A. W. Breiner

[57] ABSTRACT

A putter having a soft elastomeric striking face is described. The elastomer of the striking face has a hardness of at least 70 Durometer A and a hardness less than the hardness of a golf ball, and a high resiliency with controlled dampening. This hardness permits penetration of a golf ball into the elastomer when a ball is stroked with the elastomeric face, and the resiliency and controlled dampening causes the stroked ball to rebound from the face at a distance at least as great as the distance of the rebound of the ball when the ball is stroked with an equal force with a metal putter head of equal mass. Additionally, the resilient face imparts to the putter an improved sense of touch and feel without sacrificing distance.

In FIGS. 1–5 of the drawing different species of the golf clubs of the present invention are disclosed. In FIG. 1 resilient face 6 extends across the front of the club head; in FIG. 2 the resilient face 6 is partially indented in the club head; in FIGS. 3 and 4 the resilient face 6 extends entirely around the club head; and in FIG. 5 the resilient face is in two sections, the forward section having a low rebound response and the rear section having a high rebound response. In FIG. 6, attachable resilient pads having different rebound characteristics are provided. The preferred resilient face is made of ADIPRENE 5418 which is a urethane elastomer manufactured and sold by the duPont Company.

11 Claims, 6 Drawing Figures

GOLF PUTTER

FIELD OF INVENTION

This invention relates to golf clubs. More particularly, this invention relates to golf putters having a soft striking face of controlled properties which imparts to the golfer using the putter improved touch, feel, and control, and enhanced ball rebound response from the putter face.

BACKGROUND OF INVENTION

It is recognized by a golfer that the game of golf has two fundamentally distinct aspects. One aspect is on the driving tee and fairway, and the other is on the putting green. On the driving tee and fairway the golfer looks to equipment which will maximize the distance of ball travel even at some sacrifice in ball control. Golf woods and irons, therefore, normally utilize a relatively heavy head set at the end of a relatively long shaft. These woods and irons are normally swung with the greatest power possible, consistent with position and conditions on the golf course, all to provide greater distance of ball travel. It has been suggested to incorporate into the head or face of a wood a plastic material having high resiliency and hardness to provide greater distances of ball travel.

On the putting green, the golfer is not primarily concerned with power and distance, but needs to accurately propel the ball to and into the hole with as few strokes as possible. Accurate propulsion of the ball to and into the hole requires a sense of touch and feel by the golfer between the golf ball on the green and his putter. The desire of the golfer to maximize the touch and feel necessary to accurately control the direction of the ball movement and the distance of the ball movement on the putting green has led to literally hundreds of putter shapes and designs. The various shapes and designs have included putters having heads with an increased mass to increase the distance of ball travel with a short backswing, which increases accuracy; localization and balancing of the mass in the head to improve directional accuracy; decreased mass in the putter head to provide increased accuracy, and the use of a striking face made of rubber or plastic material to impart a sense of feel and touch while controlling the rebound characteristics of the ball when struck with the rubber or plastic face of the putter. The various putter designs and various metal striking faces of different shapes and weights have received a mixed degree of success. However, up until now no putter having a rubber or plastic striking face has been successfully marketed and none are presently being marketed.

OBJECTS AND GENERAL DESCRIPTION OF THIS INVENTION

Accordingly, it is a primary object of this invention to provide a golf putter having a soft face formed from an elastomer chemically formulated to provide enhanced touch, feel, and ball control, as well as controlled rebound characteristics.

Heretofore when a golf putter utilizing a rubber or plastic face has been suggested, it was believed that the essential characteristic of the rubber or plastic was high hardness. It was believed that a soft material gave a slow rebound, and that increased hardness gave an increased rebound and increased speed as well as what was believed to be the necessary durability. Accordingly, hardness was the ultimate and only criteria used in the selection of the elastomer.

It has now been determined that high hardness is not required and, in fact, can be detrimental to providing a striking face on a putter having the critical characteristics of touch, feel, and ball control. Rubber and plastic resilient faces having high hardness as described in the prior art were placed on putters having a metal head and contrary to expectation, the putters did not provide improved touch and feel. Moreover, the rebound characteristics were substantially lowered relative to a putter with a metal striking face. Surprisingly, however, it has been discovered that an elastomer having high resiliency, i.e., a resiliency above about 45% rebound (Bashore) with a minimum hardness of about 70 Durometer A and preferably a hardness below the hardness of a golf ball which is in the range of, or above 99 Durometer A and 50 Durometer D at the surface of the ball, gave excellent touch and feel permitting accurate ball control. Additionally, such elastomers had rebound characteristics equal to or better than the rebound characteristics of a metal head.

It is believed that elastomers which have a hardness above about 70 Durometer A, but below the hardness of a golf ball, are still sufficiently soft so that the elastomer face and golf ball are compatible, which provides better touch and feel. Additionally, the coefficient of friction of elastomers having a hardness within the aforesaid range improves or contributes to the feel and touch.

It is further believed that an elastomer on a putter face having a hardness as above defined permits the golf ball when softly or gently stroked, as on a putting green, to penetrate into the elastomer face in contrast to the golf ball being compressed as is the case if the face of the putter has a hardness greater than the hardness of the ball. The high resiliency of the elastomer without shock-absorbing or dampening effect causes the ball, after penetrating into the elastomer, to rebound sharply without energy loss. The sharp rebound without energy loss increases the distance of ball travel. The increased distance of ball travel in turn permits the utilization of a shorter backswing, substantially increasing the accuracy of the swing and, thus, direction of ball travel.

Accordingly, the present invention provides a golf putter having a soft elastomeric face, the elastomer having a hardness of at least 70 Durometer A and a hardness below the hardness of a golf ball. Additionally, the elastomer has a resiliency sufficient to cause a golf ball, after penetrating into the elastomeric face to rebound a distance equal to or greater than the distance that a golf ball will rebound when stroked with an equivalent force with a metal face of a putter. This putter, because of the soft face with its unique characteristics, provides excellent touch and feel, contributing to greater control of direction and distance of a stroked golf ball. However, elastomers having the hardness and resiliency as above defined are sufficiently tough to resist abrasion and tear.

Having described the invention in general terms, a specific and presently preferred embodiment will be described in detail in reference to the illustrative drawing wherein FIG. 1 is a perspective view from the front of a preferred putter having a double wing club head and molded thereon an elastomeric face of controlled hardness and resiliency, intermediate portions of the shaft of the putter being broken away;

Figure 1:
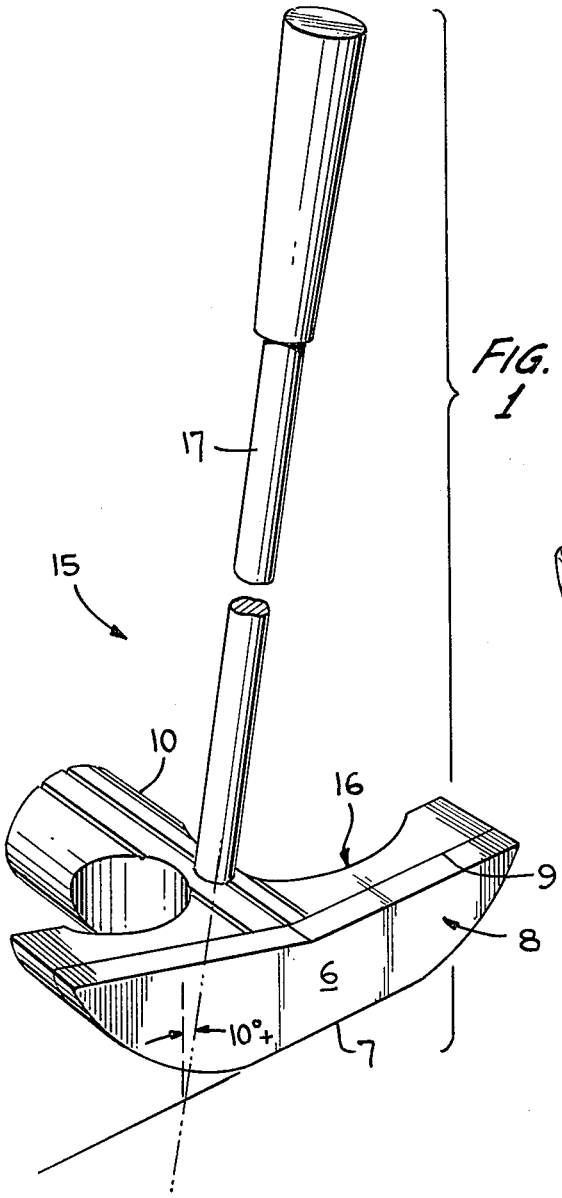

Reference is first made to FIG. 1 which illustrates a putter generally identified by the numeral 15 which includes a double wing head generally identified by the numeral 16 and a shaft 17 extending upwardly from head 16. Head 16 includes a platelike front portion 8 which includes a striking face 9 having a contoured base including a flat portion 7. Head 16 has a rearwardly extending body 10 to provide a substantially T-shaped putter. As shown, shaft 17 extends upwardly from the top of the rearwardly extending head portion 10 at an angle of at least 10 degrees in relation to the flat portion 7. The face 9 of the putter has molded thereto a resilient elastomer 6. The elastomer face as shown is approximately three-sixteenths (3/16") inch in thickness and completely covers face 9. The elastomer is fabricated from ADIPRENE 5418, a urethane elastomer manufactured and sold by the duPont Company. ADIPRENE 5418 is the reaction product of a polyether and diphenyl methane 4,4'-diisocyanate, the polymer terminated with free isocyanate groups which were subsequently cured with 1,4-butane-diol. The elastomer has a hardness of 83 Durometer A and a resiliency of 70% (Bashore). The hardness and resiliency compares with a hardness of 90 Durometer D and a resiliency of 15% (Bashore) for a brass metal face putter.

The putter of FIG. 1 having the elastomer face prevents a golf ball when stroked with the putter from skidding or slipping even when a backspin or twist is applied to the golf ball. This is in contradistinction to a metal face where slipping and skidding will occur. Additionally, the elastomer face permits a golf ball to penetrate into the elastomeric face when stroked with a golf putter due to its relatively low hardness in relation to the golf ball, with the ball rebounding sharply from the elastomer and rebounding a distance greater than the distance of rebound of a golf ball when struck with a metal face putter with equal force.

In contradistinction, an elastomeric face made from each of ADIPRENE L-100, a urethane polymer based on a polyether reacted with toluene diisocyanate and terminated with free isocyanate groups, and cured with MOCA (4,4'-methylene-bis-2-chloroaniline), and ADIPRENE L-315, a urethane polymer which is the reaction product of a polyether and toluene diisocyanate cured with MOCA failed to provide the desired feel and touch; and, additionally, had rebound characteristics inferior to the rebound characteristics of a metal face putter. The L-100 polymer had a hardness of 90 Durometer A and a resiliency of approximately 50%, whereas ADIPRENE L-315 had a hardness of 99+ Durometer A, 73 Durometer D, and a resiliency of approximately 50%.

The aforesaid examples establish the critical nature of the elastomer in providing a putter having the sense of feel and touch essential for good ball control as to direction and distance.

Figure 2:
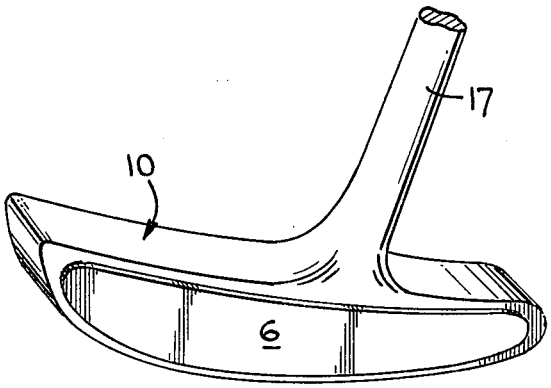
FIG. 2 is a perspective view from the front of another putter head wherein an elastomeric face of controlled hardness and resiliency is indented into a metal head.

FIG. 2 illustrates an embodiment of a putter wherein the elastomeric face 6 is indented into a brass putter head 10. The putter, therefore, has a slightly raised soft elastomeric face 6.

Figure 3:
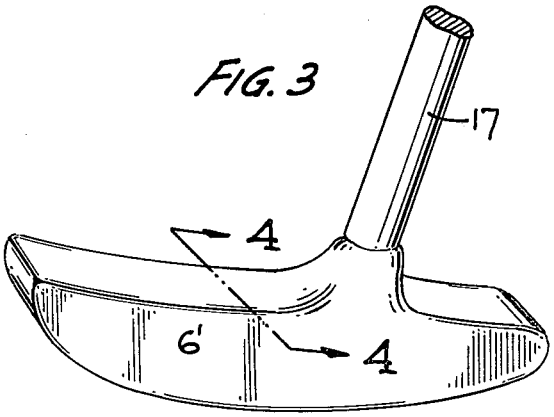
FIG. 3 is a perspective view from the front of another putter comprising a metal head portion integrally molded with the putter shaft and an elastomer having controlled properties molded entirely around the metal head portion.
Figure 4:
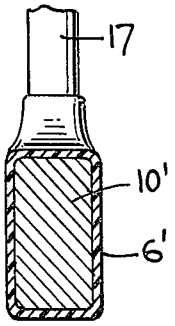
FIG. 4 is a cross-sectional view of the putter of FIG. 3 taken along line 4—4 of FIG. 3.

FIGS. 3 and 4 illustrate a putter wherein an elastomer 6' surrounds a metal head portion 10' which is integrally connected to shaft 17. The putter of this design can be used by either a right- or left-handed golfer.

Figure 5:
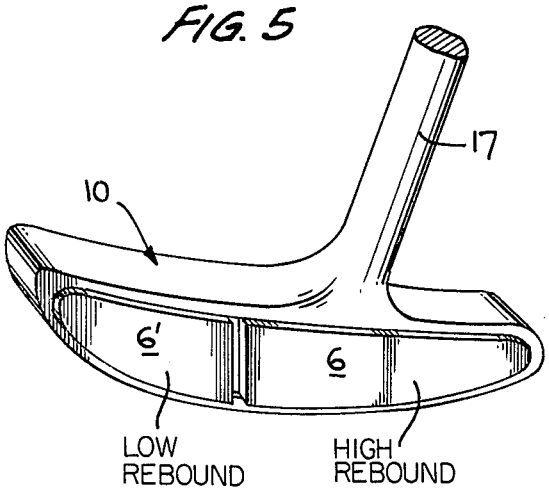
FIG. 5 is a perspective view from the front of a putter head similar to the putter illustrated in FIG. 2, but wherein the face of the putter comprises first and second elastomers.

FIG. 5 illustrates a putter having an elastomer face section 6 and an elastomer face section 6'. Face section 6 providing a first point of contact is made from the elastomer ADIPRENE 5418 having a hardness of 83 Durometer A and a resiliency of 70%. This point of contact, as hereinbefore stated, provides a sharp rebound. Face section 6' utilizes an elastomer having a lower rebound response, as for example elastomer ADIPRENE L-100. The golfer can stroke the ball with the putter of FIG. 5 so that the ball will contact face section 6 under normal putting conditions. However, if the golfer is putting downhill and desires less ball response, the toe of the putter having the face section with a lower response can be utilized to contact the ball. In this manner, the ball can be carefully controlled.

Figure 6:
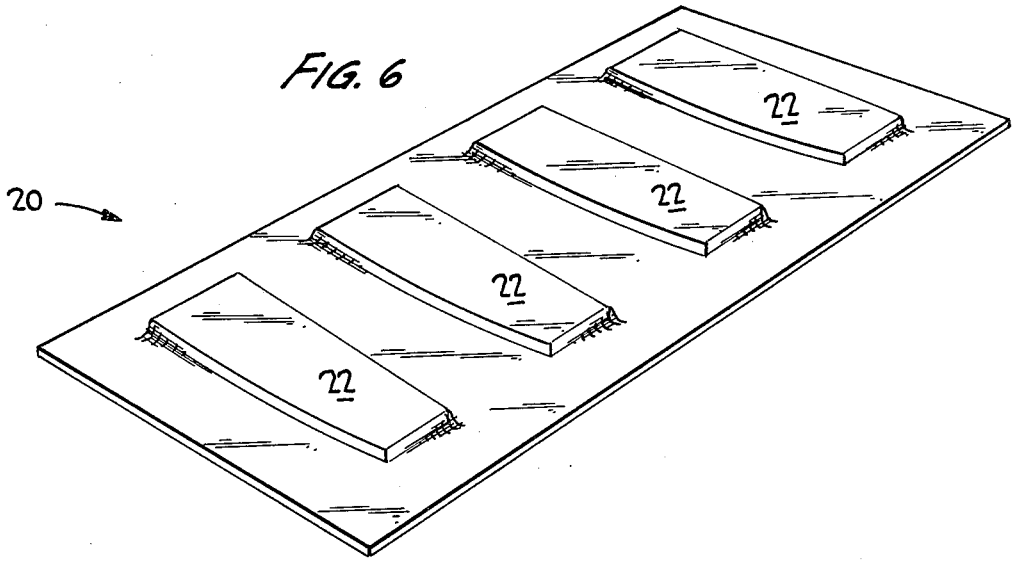
FIG. 6 is a schematic view of a package containing a plurality of elastomeric pads for affixing to the striking face of a putter.

FIG. 6 illustrates a package 20 containing four different elastomeric pads 22 having different degrees of hardness and resiliency, and different rebound characteristics. Each of the elastomer pads contained in package 20 has means on a second face thereof, such as a pressure-sensitive adhesive, which permits the bonding of the elastomer pad to the face of a putter. In this way the golfer can select the particular elastomeric face to suit his own desires, or he can change elastomer faces, if he desires. As apparent, therefore, the golfer can effectively tailor his own putter having a rebound response conforming to his particular golfing technique and desires.

As will be apparent to one skilled in the art, various polymers including polymers having different chemical formulations can be fabricated to meet the hardness and rebound characteristics essential to provide an elastomeric face in accordance with the present invention. The essential characteristic, as hereinbefore stated, is that the elastomer be chemically formulated to produce the unique rebound response which permits penetration of the elastomer by a golf ball when stroked and a sharp rebound without substantial energy loss. Urethane polymer ADIPRENE 5418 is illustrative of such elastomers. Moreover, the thickness of the elastomeric face can vary. Although it has been found that a thickness of three-sixteenths (3/16") inch is acceptable, the thickness can be increased or decreased with acceptable performance of the putter.

As used herein, "percent resiliency" is determined using the standard Bashore rebound method. "Hardness Durometer A and Durometer D" are based on procedures ASTM D676-59T and ASTM D1484-59. The term "elastomer" as employed herein is used in the broad sense to include materials polymeric in nature and which have the essential hardness and resilience properties herein defined. "Controlled dampening," as used herein, means that the elastomer will permit penetration and will rebound without substantial energy loss.

"Stroked," as it is used herein, is to define the gentle or soft contact of a golf ball with a putter on a putting green in contrast to the power swing utilized by the golfer on the driving tee or fairway.

The variations as above stated and others, being within the spirit and scope of the invention, are to be covered by the appended claims.

It is claimed:

1. A putter comprising a shaft and a head having a striking face at one end of said shaft, said head having an elastomer on at least the striking area of said face of said head, said elastomer having a hardness of at least 70 Durometer A and a hardness less than the hardness of a golf ball and a high resiliency with controlled dampening, said hardness permitting penetration of a golf ball into said elastomer when a ball is stroked with said face, and said resiliency and controlled dampening causing said stroked ball to rebound from said face a distance at least as great as the distance of the rebound of said ball when said ball is stroked with an equal force with a metal putter head of equal mass.

2. The putter of claim 1 wherein the resiliency and controlled dampening causes said stroked ball to rebound from said face a distance greater than the distance of the rebound of said ball when said ball is stroked with an equal force with a metal putter head of equal mass.

3. The putter of claim 1 wherein the elastomer has a hardness of at least 70 and below 90 Durometer A, and a reiliency of greater than 60% (Bashore).

4. The putter of claim 3 wherein the elastomer is a urethane polymer.

5. The putter of claim 4 wherein the elastomer is ADIPRENE 5418.

6. The putter of claim 1 wherein the elastomer face is bonded to a metal head.

7. The putter of claim 6 wherein the elastomer face is bonded to the metal head by casting.

8. The putter of claim 6 wherein the elastomer face is bonded to the metal head by molding.

9. The putter of claim 1 wherein the elastomer face is recessed into a metal head.

10. The putter of claim 1 wherein the elastomer is molded entirely around a metal head portion and said shaft is integral with said head portion.

11. The putter of claim 1 wherein said elastomer is at substantially the striking area of said face only and a second elastomer providing a second point of contact is on the toe of said face, said second elastomer having a slower rebound response thereby providing first and second points of contact on said face having different rebound characteristics.

* * * * *